United States Patent [19]

Hartmannsgruber et al.

[11] 4,287,711

[45] Sep. 8, 1981

[54] MOUNTABLE TUBE FOR A TEXTILE SPINDLE

[75] Inventors: Max Hartmannsgruber, Kirchheim; Egon Nigg; Kurt Hack, both of Ebersbach, all of Fed. Rep. of Germany

[73] Assignee: Firma Zinser Textilmaschinen GmbH, Ebersbach, Fed. Rep. of Germany

[21] Appl. No.: 134,398

[22] Filed: Mar. 27, 1980

[30] Foreign Application Priority Data

Apr. 4, 1979 [DE] Fed. Rep. of Germany ..... 2913500

[51] Int. Cl.[3] ..... B65H 75/02

[52] U.S. Cl. ..... 57/130

[58] Field of Search ..... 57/129, 130, 131, 132, 57/135; 242/35, 118, 118.3, 118.31, 118.32

[56] References Cited

U.S. PATENT DOCUMENTS

| | | | |
|---|---|---|---|
| 1,772,204 | 8/1930 | Codoret | 242/118.32 |
| 2,541,802 | 2/1951 | Wood | 57/130 |
| 3,552,113 | 1/1971 | Staufert | 57/130 |

FOREIGN PATENT DOCUMENTS

| | | | |
|---|---|---|---|
| 260060 | 2/1949 | Switzerland | 57/130 |

*Primary Examiner*—Donald Watkins

*Attorney, Agent, or Firm*—Edwin E. Greigg

[57] ABSTRACT

A method of producing a mountable tube for use with a textile spindle and the article produced by the method is revealed herein. The mountable tube is produced by cylindrical hammering of a steel body which may be provided interiorly thereof with a perforated insert body incapable of being deformed under the hammering process, but capable of being held within said mountable tube subsequent to completion of the hammering operation. The insert body is arranged to support the mountable tube on the textile spindle.

6 Claims, 3 Drawing Figures

MOUNTABLE TUBE FOR A TEXTILE SPINDLE

BACKGROUND OF THE INVENTION

The invention relates to a method of producing the mountable tube of the upper spindle portion of a textile spindle for ring spinning or ring twisting machines, and a mountable tube produced in accordance with this method.

The upper spindle portions of textile spindles for ring spinning and ring twisting machines have a spindle shaft which is supported in a bearing housing. In such spindles it is known to dispose a mountable tube of sheet metal on the spindle shaft (German Pat. No. 816 209), the yarn tube which is intended to be carried by this upper spindle portion being placeable onto this mountable tube. This known mountable tube comprises two individual tubes seated one over the other and produced by deep drawing or cold press molding. The production of these individual tubes by deep drawing or cold press molding, however, is difficult and expensive; and producing the mountable tube from two individual tubes impairs its precision as well.

OBJECTS AND SUMMARY OF THE INVENTION

It is accordingly a principal object of the invention to produce a mountable tube of this kind at favorable cost with entirely sufficient precision.

This object is attained, on the basis of a method in accordance with the preamble to claim 1, in that the mountable tube is shaped in one-piece, tubular form from a metal element by the cylindrical hammering method.

Producing the mountable tube by the cylindrical hammering method has a series of advantages. The cylindrical hammering method can be performed at favorable cost and also does not require very great expenditure in terms of tools. The manufacturing precision which is attainable at favorable cost is entirely sufficient. The mounting tube can furthermore be produced with relatively thin walls, so that little raw material is consumed in manufacture and the particular upper spindle portion can accordingly be relatively light in weight, which is advantageous. Because the mountable tube is furthermore embodied in one piece, it is particularly stable and reliable in operation as well. Finally, it is not difficult to embody the mountable tube in the very stretched-out, slender form which is required in textile spindles.

The metal element from which the mountable tube is manufactured may preferably be of steel and have a wall thickness of preferably ca. 1.2 to 1.8 mm. In many cases, other raw materials, which can be worked by the cylindrical hammering method, can also be considered, preferably cylindrically hammerable lightweight metal alloys.

The spindle shaft of the upper spindle portion may be made of tempered steel, as is conventional, and its base, which is intended to be inserted into the bearing housing of the textile spindle and is rotatably supported, can protrude downward beyond the mountable tube or, in many cases, can be located entirely outside the mountable tube. The mountable tube can be secured directly to this spindle shaft. However, it is generally better and more cost-favorable to secure the spindle shaft in a rigid insert body, preferably of metal, which is in turn secured in the mountable tube, this insert body having a bore coaxial with the mountable tube for receiving the shaft of the spindle. The spindle shaft can then be embodied as slender over its entire length; that is, it will not require an enlarged head, which reduces the cost of its manufacture and is also more favorable for tempering purposes.

In order to lend the insert body a particularly secure seat in the mountable tube, the insert body can be milled or knurled on its circumference prior to insertion. It may also be provided that the mountable tube and the insert body be welded together, preferably by butt-welding. Other means of securing the insert body can also be considered. Form-locking securing means which permit securing the insert body in combination with the cylindrical hammering process are particularly favorable. To this end, it can be preferably provided that the insert body be secured in a form-locking manner against axial twisting by means of shoulders, corrugations or the like shaped on the mountable tube by cylindrical hammering. In many cases, instead of or in addition to the cylindrical hammering, the mountable tube can be pressed into an annular groove of the insert body by means of rolling or pressing or in some other manner known to those skilled in metal working.

The invention also relates to a mountable tube of metal intended for the upper spindle portion of a textile spindle, which is manufactured according to the method of the invention and is characterized in that it is a one-piece, tubular sheath embodied by means of cylindrical hammering.

This mountable tube is inexpensive, accordingly making the upper spindle portion less expensive as well, and it is associated with further advantages. For instance, with a relatively slight wall thickness, it has a high degree of rigidity and relatively light weight.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
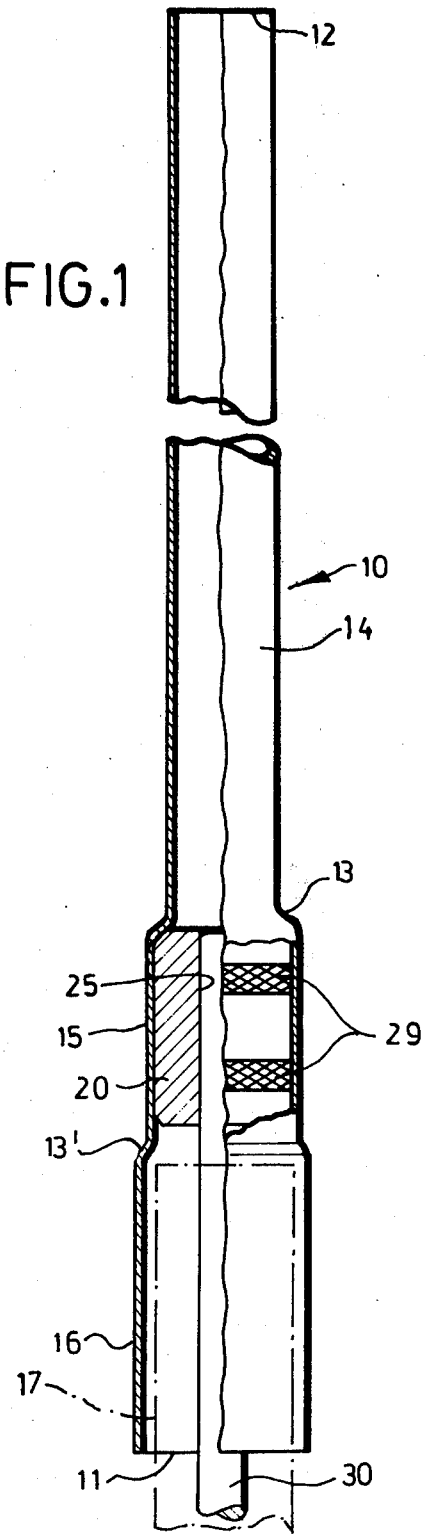
FIGS. 1–3, in partially cutaway lateral views, each show one mountable tube in accordance with exemplary embodiments of the invention, one insert body and one spindle shaft each being inserted into each mountable tube.

In the drawing, corresponding elements are provided with identical reference numerals.

Figure 2:
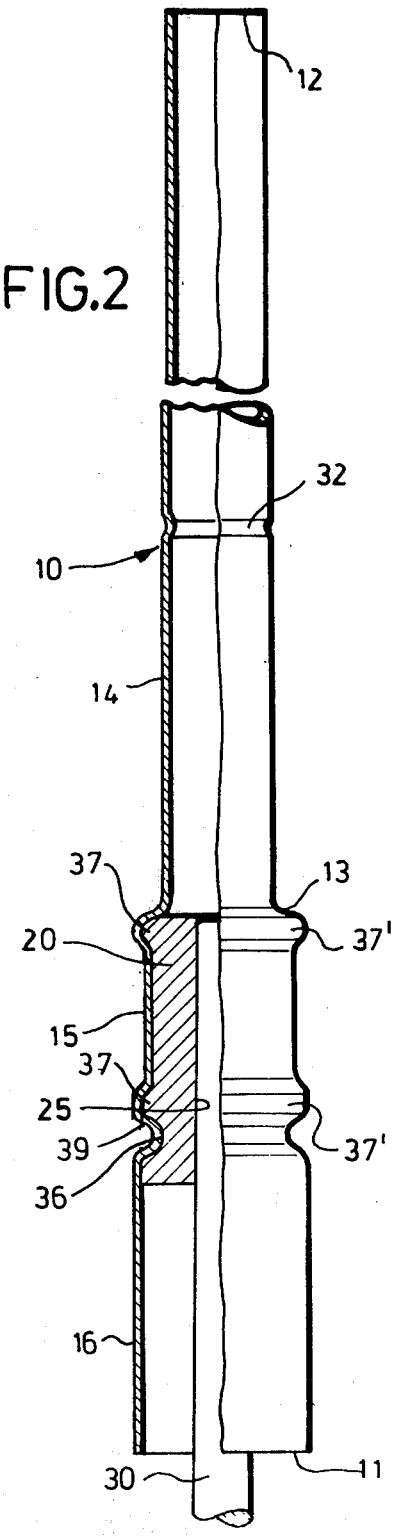
Figure 3:
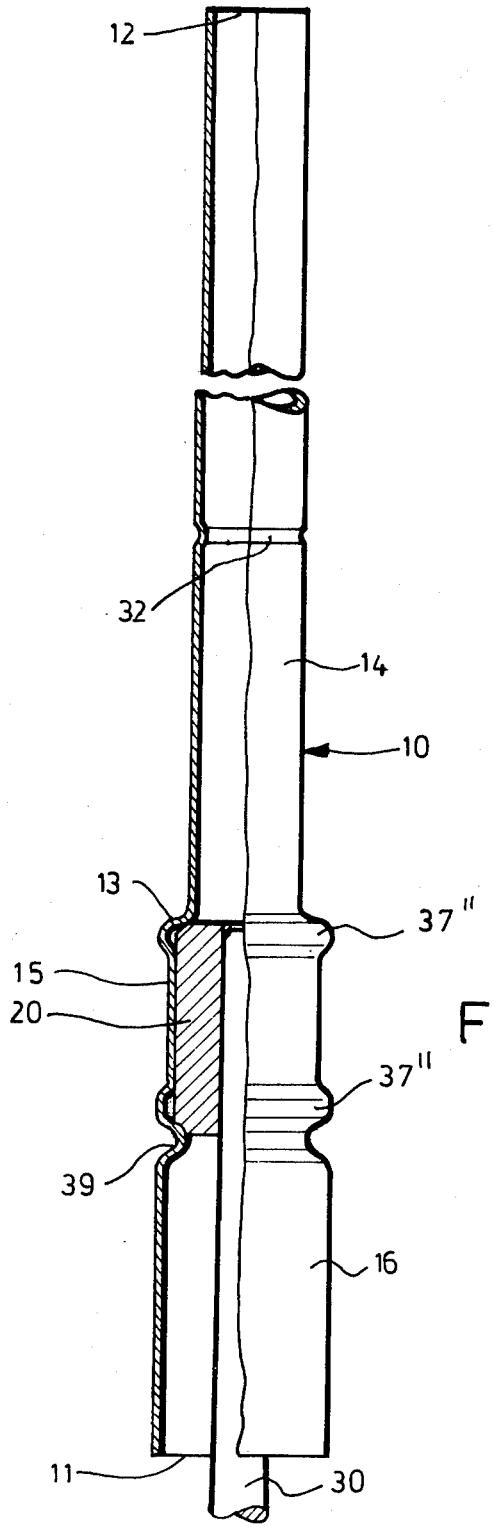

The mountable tubes 10 shown in FIGS. 1–3 are tubular, with open ends 11, 12, and are relatively thin-walled. These mountable tubes are manufactured by the cylindrical hammering method; however, after cylindrical hammering, they can also be subjected to further processing depending on requirements, such as round grinding without sharp points, turn hollowing of the spindle shaft bore, the creation of holes for tube couplings, galvanizing, and the like. Since the cylindrical hammering process is known per se, it needs not be described further.

All the mountable tubes illustrated have a long, slender form, as is required for the upper spindle portions of textile psindles. Each has a substantially cylindrical, stretched-out upper portion 14, beginning at the annular shoulder 13 and extending to the end 12, onto which a yarn tube can be placed.

Sheath couplings or the like, not shown, serving to hold the yarn tube, can also be disposed on this upper portion 14. For instance, a protrusion carrying a sheath coupling can be firmly inserted into the open end 12 of the mountable tube 10. In some cases a ring, made of plastic, for instance, can be firmly placed onto the lower end of the upper portion 14, with the base of a yarn tube being placeable on this ring for the purpose of holding the yarn tube. Frequently, it is also efficient to embody the upper portion 14 in such a manner that, approximately from the lower end outward, it narrows either steadily or in stages toward the upper end; this can also be produced by the cylindrical hammering process.

The sheath coupling may if needed also be disposed inside the upper end of the mountable tube 10, by creating holes in the wall thereof for the elastically supported coupling knobs.

Adjacent to the long, upper portion 14 of the mountable tube 10 intended for the emplacement of the yarn tube, subsequent to the annular shoulder 13, is a portion which forms a whorl 15 also shaped during the cylindrical hammering process, against which a belt, such as a tangential belt or the like, effecting the drive of the upper spindle portion rests during operation. In FIG. 1, this whorl 15 is completely cylindrical and adjacent thereto, via a lower annular shoulder 13', is a lower end portion 16 of the mountable tube. The lower end portion 16 has an enlarged diameter and, from the top, engages an upper end area of a bearing sheath 17, indicated by dot-dash lines, of the textile spindle with play on all sides.

In FIGS. 2 and 3, the whorls 15 are limited at the top and bottom by annular protrusions 37', 37'', which can likewise be formed during the cylindrical hammering process; here, however, recess hammering may preferably be provided in order to effect the undercutting of the annular protrusions.

The spindle shaft 30, which is made of massive, tempered steel and is to be inserted into the bearing housing, such as that at 17, is firmly inserted by pressing into a cylindrical bore 25, coaxial with the mountable tube 10, of a rigid, one-piece, metal insert body 20, which may likewise be of steel, this feature being provided in order that the spindle shaft 30 will not require an enlarged head. In the exemplary embodiment of FIG. 1, the insert body 20 is knurled on its circumference in two annular areas 29, and the cylindrical whorl 15 is pressed against the insert body 20 during the cylindrical hammering process. As a result of the knurled annular areas 29, the mountable tube 10 is sufficiently firmly secured to the insert body 20. Because the upper annular shoulder 13 is pressed, as shown, against the rim of the upper end face of the insert body 20, the result is also a form-locking securing of the insert body 20 against axial twisting upward within the mountable tube 10.

In the exemplary embodiments of FIGS. 2 and 3, the insert body 20 is also disposed within the whorl 15, but it is secured against axial twisting both upward and downward in a form-locking manner, as shown, by means of annular shoulders 13 or annular protrusions 37' (FIG. 2) and annular grooves 39 (FIGS. 2, 3) of the mountable tube 10 which come to rest against the insert body 20. In FIG. 3, the outer circumference of the insert body 20 is cylindrical, so that the annular protrusions 37'' of the mountable tube 10, which here limit the whorl at the top and the bottom, are hollow. This enables less expensive production of the insert body 20.

Further, in the exemplary embodiment of FIG. 2, the insert body 20 is provided on its circumference with the two annular protrusions 37 and the annular groove 36, and the mountable tube 10 is hammered in a form-locking manner onto these annular protrusions 37 and hammered into the annular groove 36 in a form-locking manner or pressed into this annular groove 36 by means of subsequent rolling. The embodiment of FIG. 2, which is structurally somewhat more expensive, has the advantage that the annular protrusions 37' of the mountable tube 10 are filled out by means of the rigid insert body 20 and thereby reinforced.

The illustrated mountable tubes 10 may preferably be manufactured from cylindrical metal pipes, which may efficiently have wall thicknesses of ca. 1.2 to 1.8 mm, and preferably of approximately 1.5 mm.

In the exemplary embodiments of FIGS. 2 and 3, one further annular groove 32 is also provided in the upper portions 14 of the mountable tubes 10 by means of hammering or rolling.

Instead of disposing the insert body 20 inside the whorl, it may in many cases also be efficiently disposed higher up, so that the bearing sheath—such as 17—can protrude into the mountable tube up to the height of the whorl, and thus the neck journal of the bearing housing can be preferably located at approximately the height of the longitudinal center of the whorl.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A metallic mountable tube for the upper spindle portion of a textile spindle in which:

said mountable tube is formed from a one-piece tubular sheath and includes a lower whorl portion.

2. A mountable tube as defined by claim 1, characterized in that said mountable tube further includes an insert body having a reception bore for a spindle shaft firmly disposed in said tube.

3. A mountable tube as defined by claim 2, characterized in that said whorl has a length and said insert body is disposed at the length of said whorl.

4. A mountable tube as defined by claim 3, characterized in that said insert body has at least one annular groove, into which said whorl portion of said mountable tube engagingly protrudes in form-locking fashion.

5. A mountable tube as defined by claim 3, characterized in that said insert body has at least one annular protrusion on its circumference, over which said whorl portion of the mountable tube engagingly protrudes in form-locking fashion.

6. A mountable tube as defined by claim 1, characterized in that said mountable tube has a lower end portion which, from the top, protrudes engagingly over an upper end area of the bearing housing of a textile spindle with play on all sides.

* * * * *